US009490592B2

(12) United States Patent
Chastain et al.

(10) Patent No.: US 9,490,592 B2
(45) Date of Patent: Nov. 8, 2016

(54) COAXIAL BARREL FITTINGS AND COUPLINGS WITH GROUND ESTABLISHING TRAVELING SLEEVES

(71) Applicant: PerfectVision Manufacturing, Inc., North Little Rock, AR (US)

(72) Inventors: Robert J. Chastain, Maumelle, AR (US); Glen D. Shaw, Conway, AR (US)

(73) Assignee: PerfectVision Manufacturing, Inc., North Little Rock, AR (US)

( * ) Notice: Subject to any disclaimer, the term of this patent is extended or adjusted under 35 U.S.C. 154(b) by 0 days.

(21) Appl. No.: 14/515,985

(22) Filed: Oct. 16, 2014

(65) Prior Publication Data

US 2015/0031237 A1 Jan. 29, 2015

Related U.S. Application Data

(63) Continuation of application No. 13/466,543, filed on May 8, 2012, now Pat. No. 8,888,527.

(60) Provisional application No. 61/628,141, filed on Oct. 25, 2011.

(51) Int. Cl.
*H01R 24/54* (2011.01)

(52) U.S. Cl.
CPC ..... *H01R 24/542* (2013.01); *H01R 24/545* (2013.01)

(58) Field of Classification Search
CPC ..... H01R 24/38; H01R 24/40; H01R 24/42; H01R 24/44; H01R 24/46; H01R 24/48; H01R 24/50; H01R 24/52; H01R 24/525; H01R 24/54; H01R 24/542; H01R 24/545; H01R 24/547
See application file for complete search history.

(56) References Cited

U.S. PATENT DOCUMENTS 2,082,986 A * 6/1937 Staley ..... H01R 13/4538 439/140
3,275,970 A * 9/1966 Johanson ..... H01R 24/40 439/263
3,350,680 A * 10/1967 Mayer ..... H01R 13/193 439/837
3,416,125 A * 12/1968 Theve ..... H01R 24/52 439/638
3,686,623 A * 8/1972 Nijman ..... H01R 9/05 439/581
3,742,426 A * 6/1973 Huber ..... H01R 13/635 439/141
3,757,279 A 9/1973 Winston
4,099,825 A * 7/1978 Jackson ..... H01R 24/542 200/51.1
4,227,765 A * 10/1980 Neumann ..... H01R 24/52 439/248
4,346,958 A * 8/1982 Blanchard ..... H01R 24/40 439/584

(Continued)

*Primary Examiner* — Ross Gushi
(74) *Attorney, Agent, or Firm* — Carmody Torrance Sandak & Hennessey LLP

(57) ABSTRACT

Barrel connectors, a right angled adaptor and a single ended fitting include at least one axially displaceable traveling sleeve for insuring electrical continuity with coaxial connector, nominally an F-connector. Each barrel connector described comprises a rigid, metallic hollow body housing an internal contact tube. At least one coiled spring is retained within the body. At least one elongated, tubular traveling sleeve is coaxially disposed within each body end and normally biased outwardly by the springs. The metallic traveling sleeves comprise an elongated shank that contacts the spring, and a head that seats against the connector body ends during installation. Catches or rings defined upon or mounted to travelling sleeve shanks are received within suitable grooves for anchoring the traveling sleeves while facilitating limited axial displacements. The traveling sleeves, and the contact tube therewithin, normally are biased outwardly so that even limited torquing of an F-connector will establish a ground path.

35 Claims, 12 Drawing Sheets

(56) References Cited

U.S. PATENT DOCUMENTS 4,660,921 A * 4/1987 Hauver ..... H01R 13/719 333/22 R
4,789,351 A * 12/1988 Fisher, Jr. ..... H01R 13/6315 439/248
4,815,986 A * 3/1989 Dholoo ..... H01R 13/631 439/248
4,897,045 A * 1/1990 Dyck ..... H01R 4/52 439/578
4,941,846 A * 7/1990 Guimond ..... H01R 24/542 439/180
5,096,444 A * 3/1992 Lu ..... H01R 24/542 439/578
5,242,316 A 9/1993 Gartzke et al.
5,329,262 A * 7/1994 Fisher, Jr. ..... H01R 13/6315 333/260
5,498,175 A * 3/1996 Yeh ..... H01R 24/542 439/276
5,516,303 A * 5/1996 Yohn ..... H01R 13/6315 439/248
5,562,464 A * 10/1996 Lecourtois ..... H01R 24/46 200/51.05
5,598,132 A * 1/1997 Stabile ..... H01R 24/46 333/22 R
5,658,171 A * 8/1997 Pauza ..... H01R 13/5202 439/675
5,700,160 A * 12/1997 Lee ..... H01R 24/542 439/578
5,704,809 A * 1/1998 Davis ..... H01R 13/434 439/349
5,730,622 A 3/1998 Olson
5,746,619 A * 5/1998 Harting ..... H01R 24/40 439/352
5,820,408 A 10/1998 Wang
5,863,226 A * 1/1999 Lan ..... H01R 9/0503 439/578
5,865,654 A * 2/1999 Shimirak ..... H01R 13/11 439/578
5,921,793 A * 7/1999 Phillips ..... H01R 24/44 439/188
6,019,622 A * 2/2000 Takahashi ..... H01R 24/46 200/51.1
6,065,997 A * 5/2000 Wang ..... H01R 24/542 439/578
6,071,144 A 6/2000 Tang
6,113,431 A * 9/2000 Wong ..... H01R 9/0521 439/638
6,123,581 A * 9/2000 Stabile ..... H01R 24/44 439/578
6,146,168 A * 11/2000 Ishii ..... H01R 13/7031 439/188
6,227,868 B1 * 5/2001 Wlodarski ..... H01R 24/40 439/63
6,250,960 B1 * 6/2001 Youtsey ..... H01R 9/0503 439/578
6,276,970 B1 * 8/2001 Wong ..... H01R 24/542 439/578
6,309,251 B1 * 10/2001 Tang ..... H01R 9/05 439/263
6,344,736 B1 * 2/2002 Kerrigan ..... G01R 1/0416 324/750.16
6,350,155 B1 * 2/2002 Mullinger-Bausch . H01R 35/04 439/30
6,361,348 B1 * 3/2002 Hall ..... H01R 13/6277 439/352
6,547,592 B2 * 4/2003 Boillot ..... H01R 24/46 439/188
6,572,405 B2 * 6/2003 Lin ..... H01R 24/50 439/188
6,655,991 B2 * 12/2003 Heebe ..... H01R 13/633 439/348
6,692,286 B1 * 2/2004 De Cet ..... H01R 13/6277 439/350
6,695,636 B2 * 2/2004 Hall ..... H01R 13/6277 439/352
6,754,060 B2 * 6/2004 Kauffman ..... H01Q 1/50 361/117
6,758,680 B2 * 7/2004 Duquerroy ..... H01R 24/50 439/63
6,761,588 B2 * 7/2004 Heebe ..... H01R 13/633 439/348
6,808,426 B2 * 10/2004 Liu ..... H01R 24/542 439/578
6,872,091 B2 * 3/2005 Huang ..... H01R 24/46 200/51.1
6,899,563 B1 * 5/2005 Lee ..... H01R 24/40 439/578
7,077,697 B2 * 7/2006 Kooiman ..... H01R 9/0527 439/247
7,201,608 B2 * 4/2007 Rosenberger ..... H01R 13/6277 439/352
7,306,484 B1 12/2007 Mahoney et al.
7,416,418 B2 * 8/2008 Berthet ..... H01R 24/50 439/63
7,416,444 B1 * 8/2008 Lin ..... H01R 13/2421 200/51.1
7,513,788 B2 * 4/2009 Camelio ..... H01R 13/6277 439/352
7,556,529 B2 * 7/2009 Wakamatsu ..... G01R 1/06772 200/51 R
7,625,247 B1 * 12/2009 Mahoney ..... H01R 9/0527 439/63
7,695,322 B2 * 4/2010 Clyatt ..... H01R 9/0515 439/578
7,883,363 B2 * 2/2011 Montena ..... H01R 24/44 439/578
7,972,173 B1 * 7/2011 Hyzin ..... H01R 13/2421 439/578
8,043,118 B1 * 10/2011 Lee ..... H01R 13/14 439/578
8,083,544 B2 * 12/2011 Chee ..... H01R 24/542 439/578
8,100,721 B2 * 1/2012 Yan ..... H01R 24/42 439/620.03
8,172,617 B2 * 5/2012 Peng ..... H01R 24/44 439/188
8,197,287 B2 * 6/2012 Rosenberger ..... H01R 24/542 439/675
8,231,398 B2 * 7/2012 Rosenberger ..... H01R 13/6315 248/675
8,298,020 B1 * 10/2012 Chen ..... H01R 4/4818 439/852
8,430,688 B2 * 4/2013 Montena ..... H01R 24/564 439/578
8,585,438 B2 * 11/2013 Tang ..... H01R 9/0524 439/578
8,641,446 B1 * 2/2014 Chen ..... H01R 24/52 439/141
8,777,658 B2 * 7/2014 Holland ..... H01R 24/46 439/578
8,888,527 B2 * 11/2014 Chastain ..... H01R 24/545 439/578
9,048,600 B2 * 6/2015 Holland ..... H01R 24/46
9,112,323 B2 * 8/2015 Goebel ..... H01R 24/46
9,130,288 B2 * 9/2015 Holland ..... H01R 13/17
9,130,328 B1 * 9/2015 Huang ..... H01R 13/2421
9,136,629 B2 * 9/2015 Holland ..... H01R 13/17
9,147,955 B2 * 9/2015 Hanson ..... H01R 13/2421
9,178,317 B2 * 11/2015 Holland ..... H01R 24/44
9,190,786 B1 * 11/2015 Baumler ..... H01R 31/06
2002/0160657 A1 * 10/2002 Boillot ..... H01R 24/46 439/578
2003/0040219 A1 * 2/2003 Lin ..... H01R 24/50 439/578
2003/0129873 A1 * 7/2003 Heebe ..... H01R 13/633 439/578
2005/0286836 A1 * 12/2005 Feinweber ..... H01R 24/40 385/76
2006/0099853 A1 * 5/2006 Sattele ..... H01R 13/6277 439/578
2006/0172561 A1 * 8/2006 Clark ..... H01R 13/6315 439/63
2007/0155231 A1 * 7/2007 Tang ..... H01R 24/547 439/578

(56) References Cited

U.S. PATENT DOCUMENTS

2007/0228839 A1* 10/2007 Yang ..... H01P 1/125 307/112
2008/0057782 A1* 3/2008 Berthet ..... H01R 13/6315 439/581
2009/0053929 A1* 2/2009 Burris ..... H01R 9/05 439/578
2009/0203257 A1* 8/2009 Clyatt ..... H01R 9/0515 439/585
2010/0015849 A1* 1/2010 Lee ..... H01R 9/0515 439/578
2010/0178798 A1* 7/2010 Rosenberger ..... H01R 13/6315 439/578
2011/0045694 A1* 2/2011 Chee ..... H01R 24/542 439/578
2011/0076885 A1* 3/2011 Shaw ..... H01R 13/111 439/582
2011/0244720 A1* 10/2011 Peng ..... H01R 24/44 439/578
2012/0088407 A1* 4/2012 Natoli ..... H01R 24/564 439/585
2012/0252265 A1* 10/2012 Wild ..... H01R 9/0521 439/578
2013/0102190 A1* 4/2013 Chastain ..... H01R 24/545 439/583
2013/0115809 A1* 5/2013 Hanson ..... H01R 13/2421 439/578
2013/0137300 A1* 5/2013 Eriksen ..... H01R 9/0524 439/583
2013/0171870 A1* 7/2013 Chastain ..... H01R 13/512 439/583
2013/0244481 A1* 9/2013 Holland ..... H01R 24/46 439/578
2013/0244509 A1* 9/2013 Holland ..... H01R 24/46 439/840
2013/0266275 A1* 10/2013 Holland ..... H01R 24/44 385/90
2014/0024234 A1* 1/2014 Holland ..... H01R 13/17 439/131
2014/0315428 A1* 10/2014 Holland ..... H01R 24/46 439/578
2015/0031237 A1* 1/2015 Chastain ..... H01R 24/545 439/582
2015/0038009 A1* 2/2015 Gibson ..... H01R 13/6581 439/578
2015/0263463 A1* 9/2015 Holland ..... H01R 24/46 439/578
2015/0288084 A1* 10/2015 Shaw ..... H01R 9/0503 439/578

* cited by examiner

COAXIAL BARREL FITTINGS AND COUPLINGS WITH GROUND ESTABLISHING TRAVELING SLEEVES

CROSS REFERENCE TO RELATED APPLICATION

This application is a continuation of Application No. 13/466,543, filed May 8, 2012, which is based upon, and claims priority from, prior pending U.S. Provisional Patent Application Ser. No. 61/628,141, Filed Oct. 25, 2011, entitled "Coaxial Barrel Fittings with Ground Establishing Traveling Sleeves" by coinventors Robert J. Chastain and Glen D. Shaw.

BACKGROUND OF THE INVENTION

1. Field of the Invention

The present invention relates generally to coaxial cable connectors, couplings and fittings such as barrel connectors. More particularly, the present invention relates to socketed, female-type coaxial fittings adapted to establish a proper ground when coupled to male connectors. Known prior art is classified in United States Patent Class 439, Subclasses 497, 578, 851, and 852.

2. Description of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of socketed receptacles, forming the "female" portion of the connection. Barrel connectors, for example, have a pair of female terminal ports, one on each end, and they join two F-connector borne cables together. F-connectors have numerous advantages over other known fittings, such as RCA, BNC, and PL-259 connectors, in that no soldering is needed for installation, and costs are reduced as parts are minimized.

For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of analogous connectors are seen in U.S. Patent Class 439, particularly Subclass 578.

However, the extremely high bandwidths and frequencies distributed in conjunction with modern satellite installations necessitates a variety of strict quality control factors. For example, the electrical connection established by the F-connector must not add electrical resistance to the circuit. It must exhibit a proper surge impedance to maintain a wide bandwidth, in the order of several Gigahertz. Numerous physical design requirements exist as well. For example, connectors must maintain a proper moisture seal against the environment, and they must function over long time periods through extreme weather and temperature conditions. Requirements exist governing frictional insertion and disconnection or withdrawal forces as well.

Importantly, since a variety of coaxial cable diameters exist, it is imperative that satisfactory F-connectors function with differently sized cables, such as RG-6 and RG-59 coaxial cables that are most popular in the satellite television art.

The foregoing F-connector considerations relate directly to the structure of the "female" sockets or receptacles to which the F-connectors are fitted. The "female" half of the junction must compliment the F-connector design imperatives. High bandwidth must be maintained through the junction, and reliable and effective impedance control is necessary. The socket, for example, must not exhibit an impedance discontinuity that can effect bandwidth. Electrical continuity is imperative.

Common receptive sockets to which F-connectors are fitted typically include some form of coaxial tube disposed therewithin into which the innermost conductor of the coaxial cable (i.e., that forms the "male" end of the connection that projects outwardly from the front of the F-connector) is inserted. A proper electrical contact must be formed at the latter juncture, internally of the mated connector elements. A variety of design constructions have been proposed for insuring such a connection.

For example, U.S. Pat. No. 4,128,293 issued Dec. 5, 1978 provides enhanced connections with an elongated, metallic band having a plurality of substantially parallel fingers. One end of each finger is attached to and integral with the band. The fingers provide a large surface area for electrical contact.

U.S. Pat. No. 4,447,108 issued May 8, 1984 discloses an improved socket for electrical connectors defined by twisting of a cylindrical inner sleeve. Slots arranged on the cylindrical surface of the sleeve are inclined with respect to the longitudinal sleeve axis. The shape of the slots contributes to correct sleeve deformation in response to twisting.

U.S. Pat. No. 4,550,972 issued Nov. 5, 1985 discloses a formed contact socket with circumferentially continuous rings at pin receiving ends for enhancing electrical contact, and a second circumferentially continuous ring at its inner end. An intermediate portion of the socket comprises beams which have ends integral with the rings. Inwardly formed spherical bosses are provided on the rings which engage a pin upon movement of the pin into the socket. The bosses are spaced along the axis of the socket and are encountered sequentially during axial movements of the pin into or out of the receptive socket.

U.S. Pat. No. 4,750,897 issued Jun. 14, 1988 discloses a contact apparatus with at least one segmented body formed by bars separated from each other by slots and having a curved central area. The bars have the form of a three-dimensional curve. In their end areas, the bars possess a section curved in the opposite sense to said curved central area.

U.S. Pat. No. 4,840,587 issued Jun. 20, 1989 discloses a female contact that receives a pin contact from an F-connector. Areas establishing electrical contact with the pin contact upon insertion are arranged at least approximately according to a family of straight generatrices of a hyperboloid of revolution of one branch. The composite female contact comprises a proper elastic contact element consisting of a cylindrical sleeve provided with through slots on its surface and inclined with respect to the longitudinal axis of the sleeve, which is deformed by twisting according to a predetermined angle and directed in the sense of inclination of the slots.

U.S. Pat. No. 5,667,409 issued Sep. 16, 1997 discloses a barrel connector for use with F-connectors that includes a pair of opposite "female" ends. A tubular, center conductor tube for coaxial cable including plural, inwardly punched contact points defined on the tube ends. The contacts firmly abut the central wire of coaxial cable terminating in an F-connector. The tube is constrained within a larger diameter housing with spaced sleeves. The material of the holes is punched inward but is not removed from the tube forming the contact component such that a pair of inclined planes extend toward the interior of each end of the tube.

U.S. Pat. No. 5,863,226 issued Jan. 26, 1999 discloses a connector for coaxial cable including a tubular contact fitted between two insulative sleeves. The contact member is made from sheet material by curling. Ends of the contact member are not joined together, and a narrow slit is defined between them. When a wire core with a diameter between 1.2 to 1.3 mm, i.e., as with an F-type coaxial connector, is inserted into the contact member, the contact member is stretched open to achieve greater resilience.

U.S. Pat. No. 6,113,431 issued Sep. 5, 2000 provides an F-port coaxial barrel connector. The connector body comprises threads on its opposite ends for receiving F-connectors, and a hexagonal nut formed in between, with a flat sections lathe-fabricated at the outer extremities of the aforesaid threads and a containment hole extending lengthwise through the center of the connector body. Fitted inside the containment hole is a first insulator sleeve and a second insulator sleeve, and clipped in between the first and second insulator sleeves is a tubular contact component. The utilization of lathe fabrication allows for a smooth and even finish on all flat surfaces and enables the assembly of the first insulator sleeve, the second insulator sleeve, and tubular contact component to be conveniently inserted into the containment hole, while also preventing dislodging from the containment hole.

U.S. Pat. No. 6,065,997 issued May 23, 2000 discloses an analogous connector device for use with cable and satellite television installations, including an integrally formed housing, a contact member and an insulative tube fitted in an inner through hole of the housing. An arch annular groove is formed on an inner edge of one end of the housing and an engaging flange is formed at the other end of the housing. The insulative tube is disposed with an arch annular flange. The contact member is placed in the insulative tube which is fitted into the housing with the annular flange engaged with the annular groove. Two ends of the housing are formed with plane connecting faces, whereby the tightly connecting area with the connector is increased without a gap so as to effectively isolate interference by various kinds of free waves.

U.S. Pat. No. 6,808,426 issued Oct. 26, 2004 also discloses a barrel connector for use with popular F-connectors. A conductive contact tube that is coaxially constrained within the connector by special end sleeves includes inwardly bent, clamping tabs for establishing electrical contract by grasping the coaxial cable center conductor when an F-connector is threadably fitted to then barrel connector.

U.S. Pat. No. 6,899,563 issued May 31, 2005 provides a coaxial cable connector with an internal transmission tube comprising four elastic strips at each of its two ends. The four elastic strips are disposed in the transmission tube in a bent manner, and each elastic strip is formed with a projecting plane and inclined planes. Side edges of the four elastic strips are joined to form a clamping end for inserting and connecting an axis of a coaxial cable therein.

U.S. Pat. No. 7,252,560 issued Aug. 7, 2007 discloses a center conductor for use in a coax jack module. The center conductor has a conductive body with a crimped region within one of a first half and a second half of the conductive body, that is defined by slots. Numerous other patents relating to electrical construction contact techniques exist, such as U.S. Pat. Nos. 3,317,887, 3,381,261, 3,678,451, 3,815,081, 3,861,776, 4,002,400, 4,298,242, 4,550,972, 6,186,841, 7,121,881, 7,387,548, and 7,442,080.

In our prior U.S. Pat. No. 7,931,509 an improved center tube construction for use with barrel connectors was disclosed. The improved center tube establishes contact with male connectors, nominally F-connectors. The elongated, generally tubular contact tube was mechanically fixed in position at the coaxial center of the connector. At least one female juncture for receiving a male coaxial connector was included. The contact tube, preferably made of copper beryllium alloy, includes radially spaced apart, curved slots and strips forming a polygonal enclosure whose sides dependably abut the center conductor of coaxial cable emanating from a F-connector coupled to at least one end of the connector.

Despite efforts in the industry to provide reliable, wideband connectors and accessories, problems often result where connectors are improperly installed. Existing threaded connector designs rely on proper installation techniques. For example, it is well recognized that the F connectors must be properly tightened when installed. In other words. F-connectors must be properly torqued to create a proper ground connection. Threaded F-connector nuts should be installed with a wrench to establish reasonable torque settings. Critical tightening of the F nut to the threaded female socket or fixture applies enough pressure to the inner conductor of the coaxial cable to establish proper electrical connections. A dependable electrical grounding path must be established through the connector body to the grounded shield or jacket of the coaxial cable.

Known barrel connectors depend heavily on the application of proper torque during installation. The common instillation technique is to torque the F-connector with a small wrench during installation. Absent proper application torque, the electrical grounding path can be compromised and can become intermittent. In some cases installers only partially tighten the F-connector. Some installations are only hand-tightened. In any case, resulting electrical pathways with typical known female connector designs are easily compromised when application torque is improper.

BRIEF SUMMARY OF THE INVENTION

All of the embodiments of this invention present female sockets adapted to be engaged by a coaxial connector, nominally an F-connector, that presents the male end of the connection. In each instance a center portion of the female socket is dynamic, rather than static, in that a unique traveling sleeve slides outwardly of the fitting to mate with a male connector, and then slides back into the fitting when the connector is torqued.

Each barrel connector described comprises a rigid, hollow body housing an internal contact tube that extends between the body ends. The body preferably comprises a middle portion and a pair of tubular shanks. Alternative embodiments provide only a single female socket or connection point.

Means are provided for seating at least one coiled spring within the body. Elongated tubular, traveling sleeves are coaxially disposed within the body and biased outwardly by the springs. The preferably metallic traveling sleeves comprise an elongated shank that contacts the spring. Catches are provided for captivating the traveling sleeves within the body while facilitating limited axial displacements. The traveling sleeves, and the contact tube therewithin, normally are biased outwardly so that limited torquing of an F-connector tends to establish a ground path. With the designs described herein, sufficient grounding and proper continuity are much more likely to be established, even where the applied F-connector may not be properly torqued.

Thus the primary object of our invention is to provide a female connector end construction, and a female barrel connector with such ends, that overcome electrical connection problems associated with improper connector torquing or installation.

More particularly, an object of our invention is to provide dependable electrical connections between coaxial connectors, especially F-connectors, and female connectors or sockets.

A basic object is to provide a proper ground and establish continuity in a connector installation, even though required torque settings have been ignored.

A related object is to provide a connector of the character described that establishes effective continuity and/or grounding during installation of the male connector to the various types of threaded female connections, even though applied torque may fail to meet specifications.

Another essential object is to establish a proper ground electrical path with a socket even where the male connector is not fully torqued to the proper settings.

It is also an object to provide a connector of the character described that has more than one socket, and in which connections to one of the sockets do not interfere with the ground enhancing characteristics of other sockets. It is a feature of our invention that the preferred traveling sleeve tubes can axially travel independently from one another.

A related object is to provide a barrel connector of the character described that exhibits proper impedance over extremely wide frequencies.

Another important object is to minimize resistive losses in a coaxial cable junction.

A still further object is to provide a female socket construction capable of deployment in barrel connectors, right angled connectors, ground blocks, terminals, various sockets and the like.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 12A is an enlarged, longitudinal sectional view of the preferred spring housing of FIG. 12;

DETAILED DESCRIPTION OF THE INVENTION

Detailed herein are various connector embodiments, all of which include female sockets adapted to be engaged by a coaxial connector, nominally an F-connector. The three barrel connectors described hereinafter preferably employ an internal contact tube constructed in accordance with U.S. Pat. No. 7,931,509, the disclosure of which is hereby incorporated by reference as if fully set forth herein. Various tubular contact tubes (also known as "center pins") are known in the art, and this invention is not limited to any particular center pin design. The connector embodiments described herein that are equipped with a single female socket preferably use a modified contact tube having one end configured as in U.S. Pat. No. 7,931,509. A wide variety of F-connectors may be used with any of the embodiments disclosed herein. Coaxial F-connectors described in U.S. Pat. Nos. 7,513,795 and 7,841,896 are ideal. Further, while it is to be noted that connectors depicted herein are employed with F-connectors, the teachings of the invention may be readily adapted to RCA, SMA, PL-259, BNC, type-N, and other common electrical coaxial sockets or barrel connectors that interconnect with various types of conventional coaxial cable.

First Barrel Connector Embodiment

Figure 1:
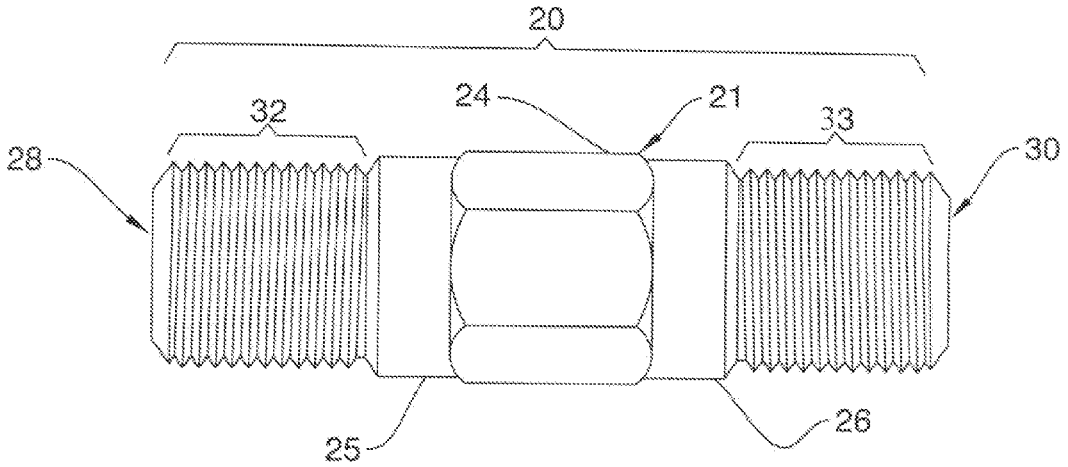
FIG. 1 is an elevational view of a first embodiment of a coaxial barrel connector with the instant traveling sleeve construction disposed therewithin.
Figure 2:
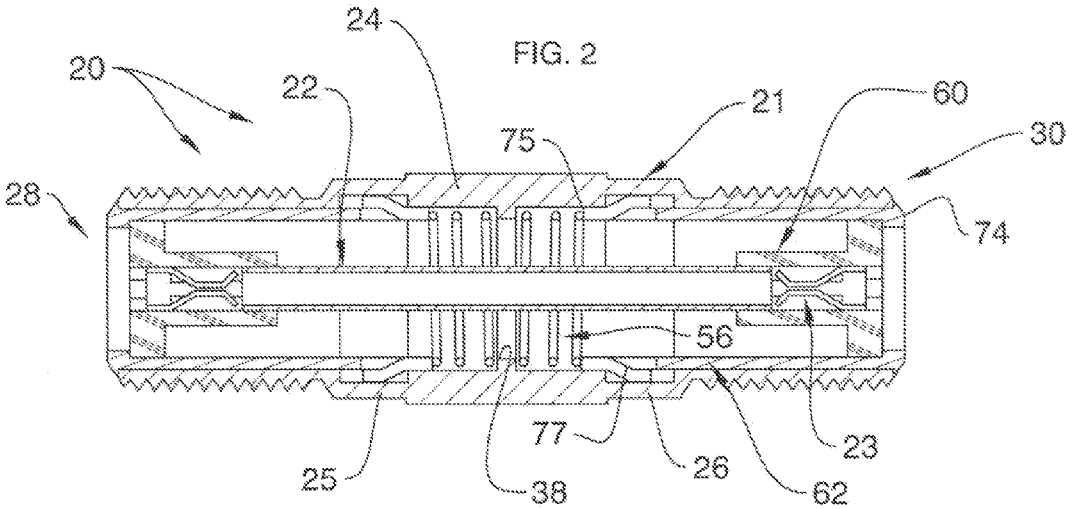
FIG. 2 is a longitudinal sectional view of the barrel connector of FIG. 1.

With initial reference directed to FIGS. 1 and 2 of the appended drawings, a barrel connector constructed generally in accordance with the best mode of the invention has been generally designated by the reference numeral 20. The elongated and hollow metallic body of the barrel connector 20 has been generally designated by the reference numeral 21. The rigid, elongated body 21 houses an internal, coaxially positioned contact tube 22 (FIG. 2) that extends between spaced-apart left and right body ends 28, 30 respectively. All contact tubes 22 are of this invention are preferably constructed from beryllium-copper alloy and. In the best mode known at this time, are of a fixed length. Suitable tubular contact tubes 22 comprise ends 23 (FIG. 2) with integral, radially compressed portions adapted to frictionally receive and engage internal conductor ends of the coaxial cable projecting from F-connectors that are to be threadably coupled to the barrel connector. A variety of differently configured contact tube ends exist in the art, and many are compatible with the structure described herein. However, the contact tubes, and the contact tube end construction of U.S. Pat. No. 7,931,509, are preferred.

The body 21 (FIGS. 1, 2) preferably comprises a middle, polygonal portion 24 integrally bounded by tubular shanks 25, 26. Portion 24 may have the cross section of a hexagon so it may be tightened or grasped with conventional wrenches. The shanks 25, 26 integrally extend to opposite, external threaded portions 32, 33 (FIG. 1) respectively that threadably connect to the head of a typical coaxial connector. Ends 28, 30 present female sockets to which F-connectors may be threadably attached to provide an interconnection.

Figure 3:
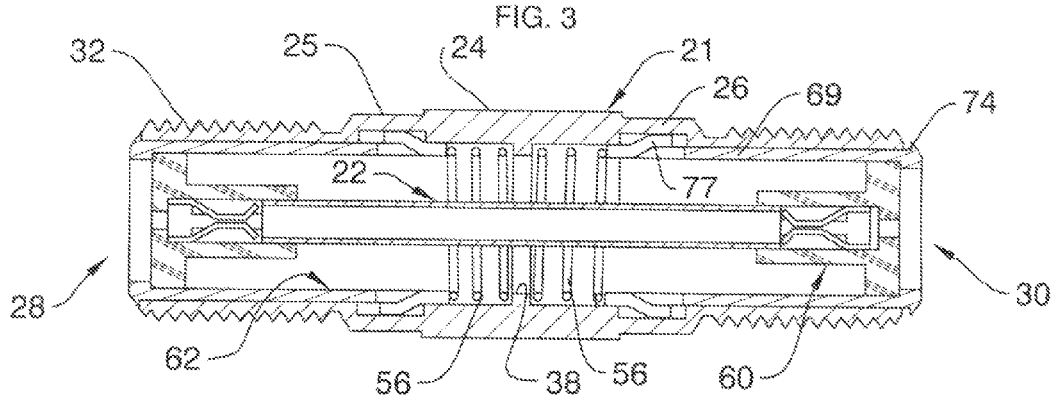
FIG. 3 is a longitudinal sectional view of the barrel connector of FIG. 1, showing one traveling sleeve partially extended.
Figure 4:
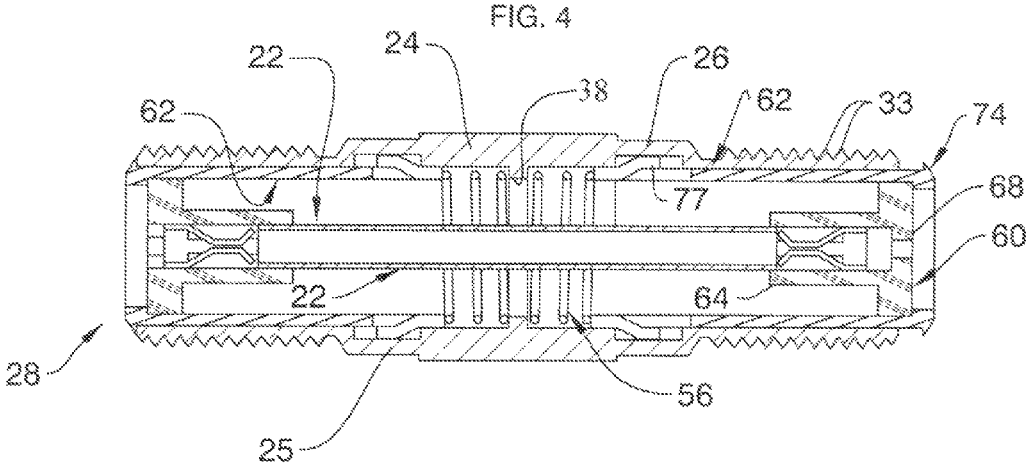
FIG. 4 is a longitudinal sectional view of the barrel connector of FIG. 1, showing one traveling sleeve fully extended.
Figure 5:
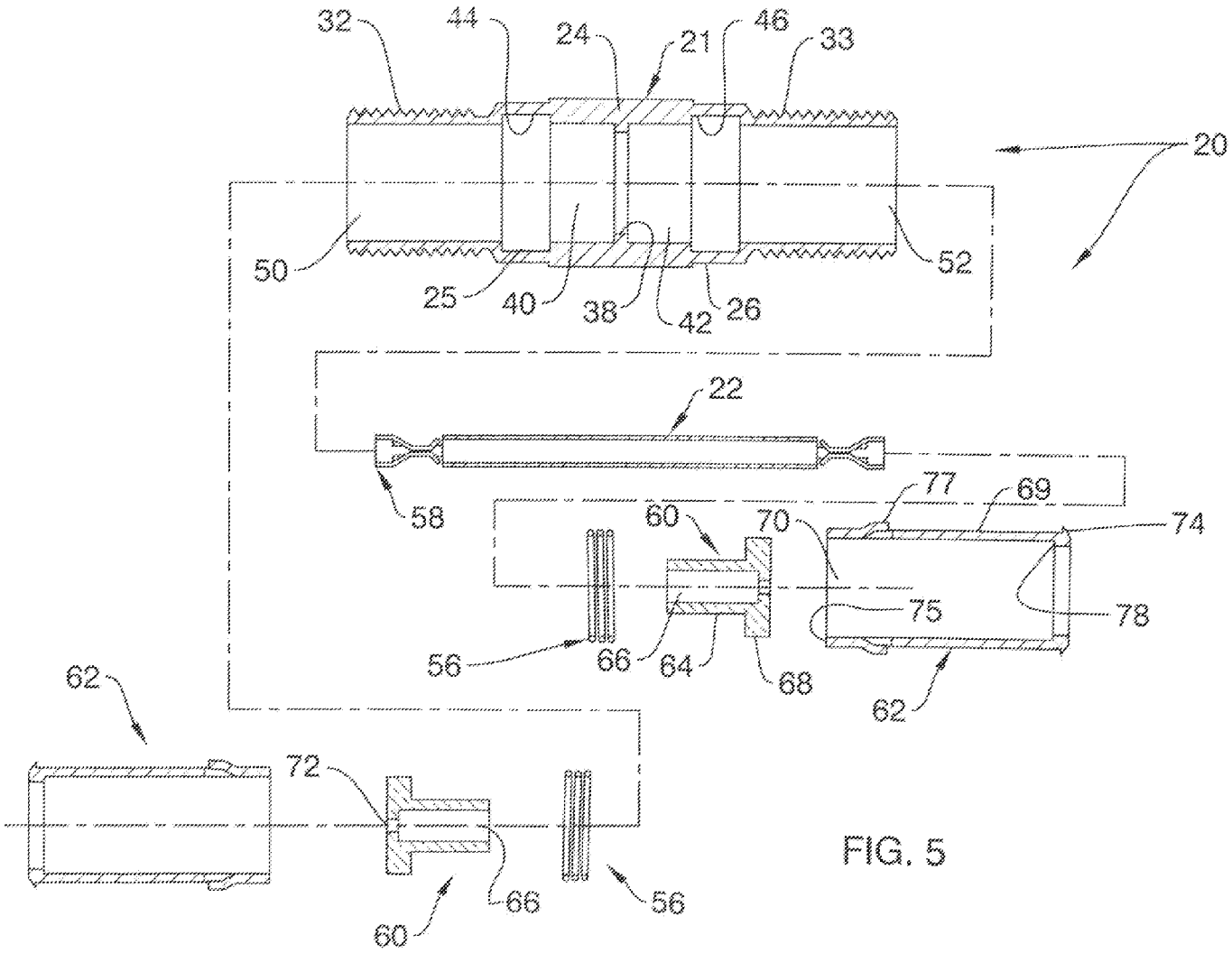
FIG. 5 is an exploded, sectional view of the barrel connector of FIG. 1.

Viewing FIGS. 2-5, the middle portion 24 of body 21 has an integral, internal retainer ring 38 that divides the internal tubular passageway within middle body portion 24 into two adjoining, cylindrical spring chambers 40 and 42 (FIG. 5). Neighboring internal anchoring grooves 44 and 46 (i.e., FIG. 5) are disposed within the body 21 and radially bounded by shanks 25 and 26 respectively. Anchoring grooves 44 and 46 have a larger diameter than the axially adjacent spring chambers 40 and 42 (FIG. 5) within middle body portion 24. The tubular passageways 50 and 52 circumscribed by the threaded portions 32, 33 are of approximately the same diameter as spring chambers 40, 42. Each spring chamber 40, 42 receives and seats a coiled, traveling sleeve biasing spring 56 that internally abuts and seats against retainer ring 38. Thus ring 38 retains springs 56 within the barrel connector 20 and limits axial spring travel.

The contact tube 22 extends coaxially within body 21, penetrating the springs 56, spring chambers 40 and 42, and anchoring grooves 44 and 46. Each end 58 of the contact tube 22 is slidably seated within an insulated bushing 60 that is in turn slidably seated within a traveling sleeve 62 (i.e., FIG. 5). Tube 22 and its ends 58 establish electrical contact with the internal conductor of an F-connector, as described in detail in U.S. Pat. No. 7,931,509 mentioned above.

Each bushing 60 is generally T-shaped in cross section. It is preferably made of plastic. An elongated hollow, tubular stem 64 defines a tubular interior passageway 66 into which ends 58 of the contact tube 22 are fitted. Stem 64 is integral with a larger diameter head 68 that slidably, coaxially fits within the hollow passageway 70 coaxially defined within travelling sleeve 62. An orifice 72 (FIG. 5) defined in each bushing head 68 allows the center coaxial cable conductor centered within an F-connector to pass through to contact tube 22 and make electrical contact therewith.

The preferably metallic traveling sleeve 62 comprises an elongated shank 69 forming internal passageway 70 (FIG. 5). In assembly the traveling sleeve 62 is coaxially and slidably disposed within body passageways 50 or 52 for limited axial displacements. A beveled head 74 has a diameter slightly larger than the diameter of shank 69. A reduced diameter, internal shoulder 78 is integrally formed in the sleeve proximate head 74. When fully pushed into passageway 52, the sleeve head 74 will contact one end 28 or 30 of the body 21 (FIG. 2). Also, the inner ends 75 of the travelling sleeve 62 will contact a spring 56 seated within spring chambers 40 and/or 42.

To anchor the traveling sleeve, it is preferred that the shank 69 include at least one protruding catch 77 (i.e., FIG. 5) formed in its periphery. In the best mode there are two radially spaced apart catches 77, but a plurality of catches can be can be radially defined about the entire circumference of the travelling sleeve shank 69. The catches 77 are resilient, and yieldably deflect inwardly during assembly when the traveling sleeve is first inserted into a passageway 50 or 52. Alternatively, the catches 77 can be designed in the form of a single notch or barb, or they can comprise protruding tongues or clips, just as long as they are appropriately configured to seat within anchoring grooves 44 or 46. The projecting catches 77 effectively establish a larger external diameter than the sleeve shank 69.

When the sleeve 62 is inserted into the body of the barrel connector, the catches 77 first retract to facilitate assembly, and then snap into the radial anchoring grooves 44, or 46 within the body 21 of the connector. Limited axial movement of the travelling sleeves is insured as the catches 77 can move axially within anchoring grooves 44 or 46 a slight distance. This captures the sleeve(s) and insures that they do not fall out. Catches 77 slidably, coaxially seat within internal grooves 44 or 46 (FIG. 5), and can travel axially within anchoring grooves 44 or 46 between the opposite groove ends. During assembly, when the traveling sleeve 62 is inserted into the body, and moved against yieldable installation pressure from the springs 56, the catches 77 eventually snap into place within anchoring grooves 44 or 46, anchoring and captivating the traveling sleeve while allowing limited axial displacements.

In FIG. 2 the sleeves 62 are fully inserted within body 21. Sleeve heads 74 abut the ends 28 or 30 of the body 21. The inner sleeve ends 75 compress and engage the coil springs 56. Catches 77 are disposed within anchoring grooves 44 or 46. At the same time the contact tube ends 23 are approximately fully engaged within passageway 66 in bushing 60, with the head 68 of bushing 60 abutting sleeve shoulder 78. In FIG. 3, the sleeve on the right is partially outwardly extended. In FIG. 4, the sleeve on the right is shown fully outwardly extended.

Figure 6:
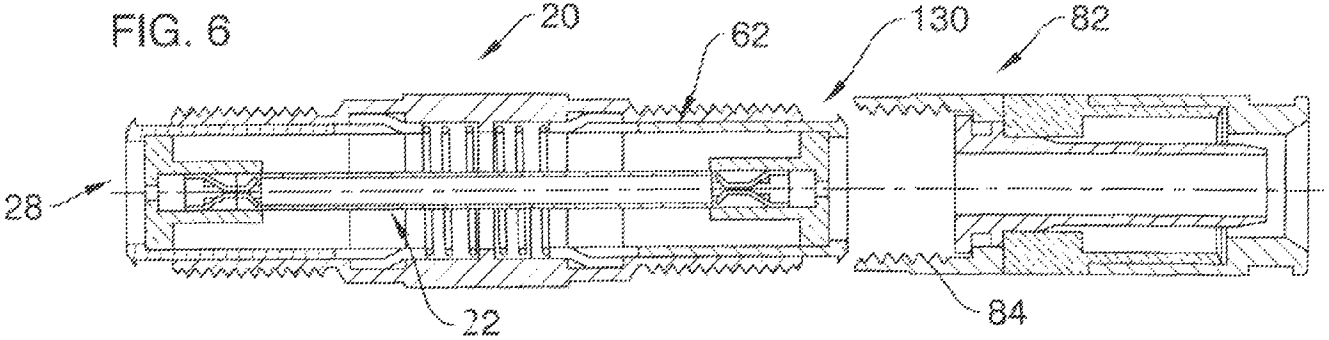
FIGS. 6-8 are exploded, longitudinal sectional views progressively showing traveling sleeve movement as an F-connector is attached to the barrel connector of FIG. 1.
Figure 7:
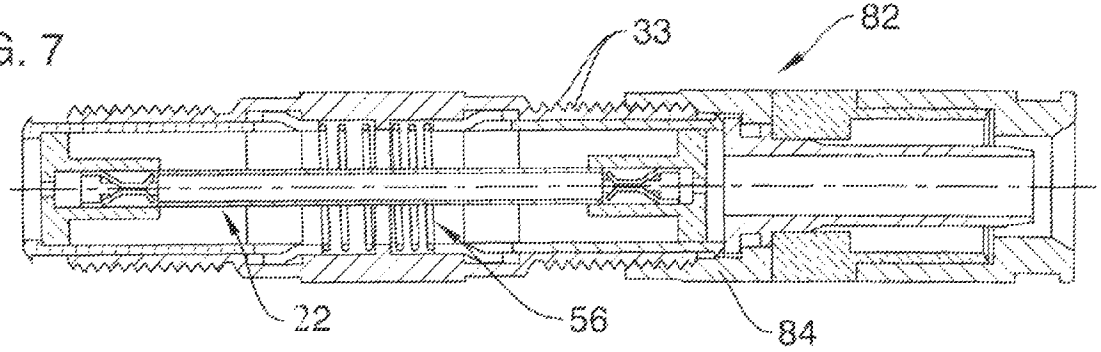
Figure 8:
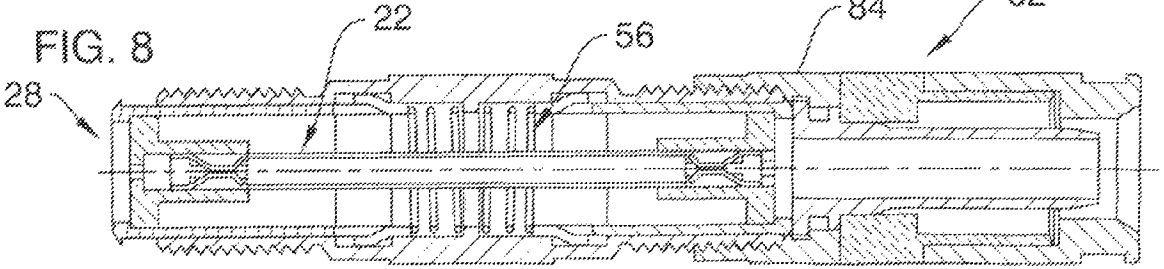

FIGS. 6-8 progressively indicate the attachment of an F-connector. FIG. 6 shows travelling sleeves fully outwardly extended, and an F-connector 82 about to be attached. FIG. 7 shows an intermediate position with the F-connector 82 partly attached, but incompletely threadably tightened or torqued. The position in FIG. 8 illustrate the right traveling sleeve 62 at the fully compressed position with the F connector 82 (FIG. 8) tightly attached. In FIG. 8 the F-connectors' hexagonal connector nut 84 is tightened against barrel connector threaded portion 33 to a fully wrench-torqued position. Grounding problems discussed earlier typically occur with prior art devices assuming intermediate, incompletely tightened positions resembling FIG. 7. Traveling sleeve pressure prevents the F-connector nut from being somewhat loose, even if the installer failed to torque it properly. In other words, the traveling sleeves "reach out" to incoming F-connectors in an attempt to insure electrical contact between the F-connector and the barrel body 21 as soon as possible, even before torquing is complete. It is also to be noted from FIG. 8 that the traveling sleeve on the left remains extended, despite the fact that the right sleeve is compressed with an F-connector attached.

In FIG. 6 traveling sleeves 62 at both ends of the connector 20 are maximally deflected out of the body 21 by spring pressure. This represents an installation point that occurs just prior to mating of the F-connector 82 (FIG. 6) with the barrel connector 20. The intermediate position seen in FIGS. 3 and 7 occurs as the F-connector first engages the barrel connector 20. The forced, outward projection of the sleeve(s) 62 overcomes the need to be absolutely sure that the F-connectors 82 are thoroughly wrench tightened against the socket. The traveling sleeve 62 maintains the around connection even after insufficient F-connector tightening. For example, a connection with an F-connector that is insufficiently tightened by approximately one and a half to two turns will still establish and maintain electrical continuity and/or appropriate grounding.

Second Barrel Connector Embodiment

With reference now directed mainly to FIGS. 9-12 of the drawings, a second barrel connector 120 comprises a hollow metallic body 121 similar to body 21 discussed above. Exteriorly body 121 appears like body 21 in FIG. 1. Body 121 houses an internal, coaxially positioned contact tube 122 that extends between spaced-apart left and right body ends 128, 130 respectively. Contact tubes 22 (FIGS. 2) and 122 (FIGS. 9-11) are similar.

Body 121 comprises a middle portion 124 integrally bounded by tubular shanks 125, and 126. Middle portion 124 may have the cross section of a polygon (i.e., preferably a hexagon) for grasping. The shanks lead to opposite threaded tubular portions 132, 133 (FIGS. 10, 12) that threadably connect to the head of a typical F-connector. Ends 128, 130 present female sockets to which an F-connector may be threadably attached.

The middle portion 124 of body 121 has an internal retainer groove 138 (FIG. 12) that is centered within body 121. The retainer ring groove 138 coaxially seats within the interior of body 121, rather than projecting interiorly into the passageway as with ring 38 discussed earlier. An elongated, tubular spring housing 140 coaxially fits within the middle body portion 124 to form a spring chamber. A peripheral protrusion 141 (FIG. 12A), preferably in the form of a ring, circumscribes the exterior of spring housing 140. The protrusion 141 can be formed from barbs, or it can comprise separate, spaced apart, protruding tongues or clips, that are yieldably deflected radially inwardly during assembly. The protrusion 141 seats within retainer ring groove 138 (FIGS. 9, 12) in assembly so housing 140 is retained. The opposite ends 142 and 144 (FIG. 12) of spring housing 140 have internal, terminal walls with circumferential barbs 145 (i.e., FIG. 12A) that retain a single coiled spring 156 that is coaxially disposed within spring housing 140. The spring 156 is captivated and thus retained between barbs 145 between opposite ends of the spring housing 140.

The contact tube 122 extends coaxially within body 121, coaxially penetrating the spring 156, and the body interior. Each end 158 of the contact tube 22 is slidably seated within an insulated bushing 160 that is slidably seated within a traveling sleeve 162 (i.e., FIG. 12). Bushings 160 are similar to bushings 60 described earlier. Elongated hollow, tubular stem 164 defines a tubular passageway 166 that receives ends 158 of the contact tube 122. Stem 164 is integral with head 168 that slidably, coaxially fits within traveling sleeve 162.

The traveling sleeves 162, 162A (FIG. 12) preferably comprise an elongated shank 169 forming an internal passageway 170. In assembly the sleeves 162 are coaxially, slidably disposed within a body passageway 152. A beveled sleeve head 174 has a diameter slightly larger than the diameter of sleeve shank 169. Internal shoulder 178 is integrally formed in the sleeve shank proximate head 174. The sleeve head 174 can contact one end 128 or 130 of the body 121. The interior end 180 of the sleeve 162 has a plurality of radially, spaced apart prongs 181 that project interiorly of the connector. Each of these prongs has a barbed end 182. It will be noted from FIGS. 9 and 10 that the sleeve prongs 181 contact ends of spring 156 in assembly. Sleeve anchoring is accomplished by the barbed, prong ends 182 that engage complimentary spring housing barbs 145 (i.e., FIG. 12A) to prevent traveling sleeve escape from the connector body.

Figure 9:
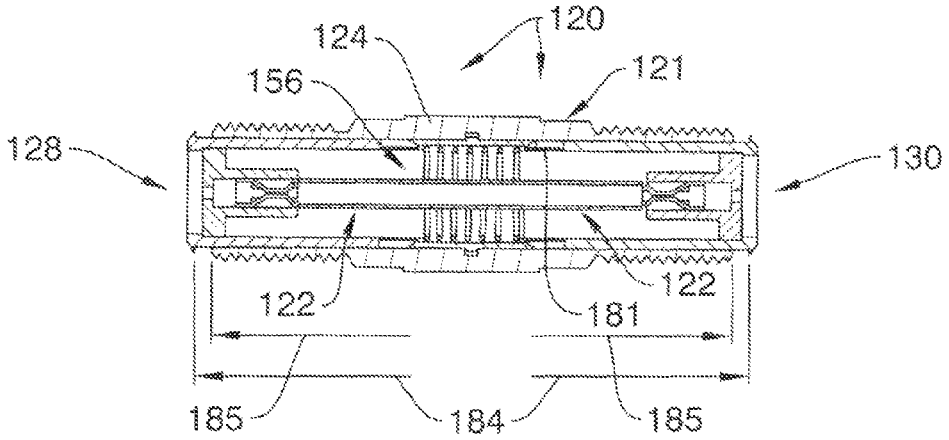
FIG. 9 is a longitudinal sectional view of a second embodiment of our barrel connector, showing the traveling sleeves fully extended.

In FIG. 9 the sleeves 162 project outwardly of body 121 because of pressure from spring 156. The maximum connector length is indicated by arrows 184. When the traveling sleeves are forced into the body interior, as when an F-connector is attached, a reduced length indicated by arrows 185 (FIG. 9) results.

Figure 10:
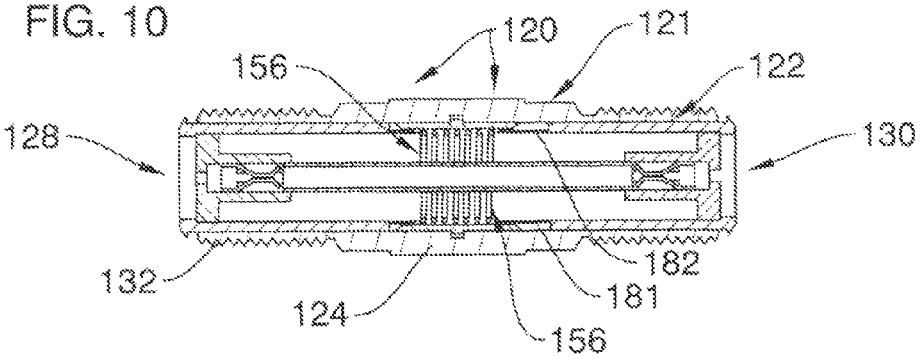
FIG. 10 is a longitudinal sectional view of the second embodiment of our barrel connector, showing the traveling sleeves partially extended.
Figure 11:
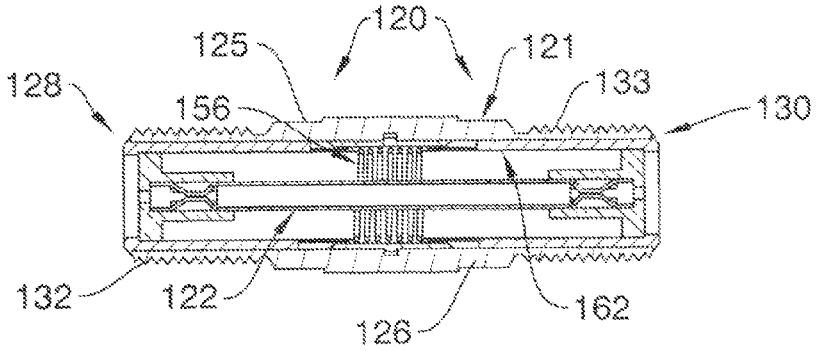
FIG. 11 is a longitudinal sectional view of the second embodiment of our barrel connector, showing the traveling sleeves compressed inwardly.
Figure 12:
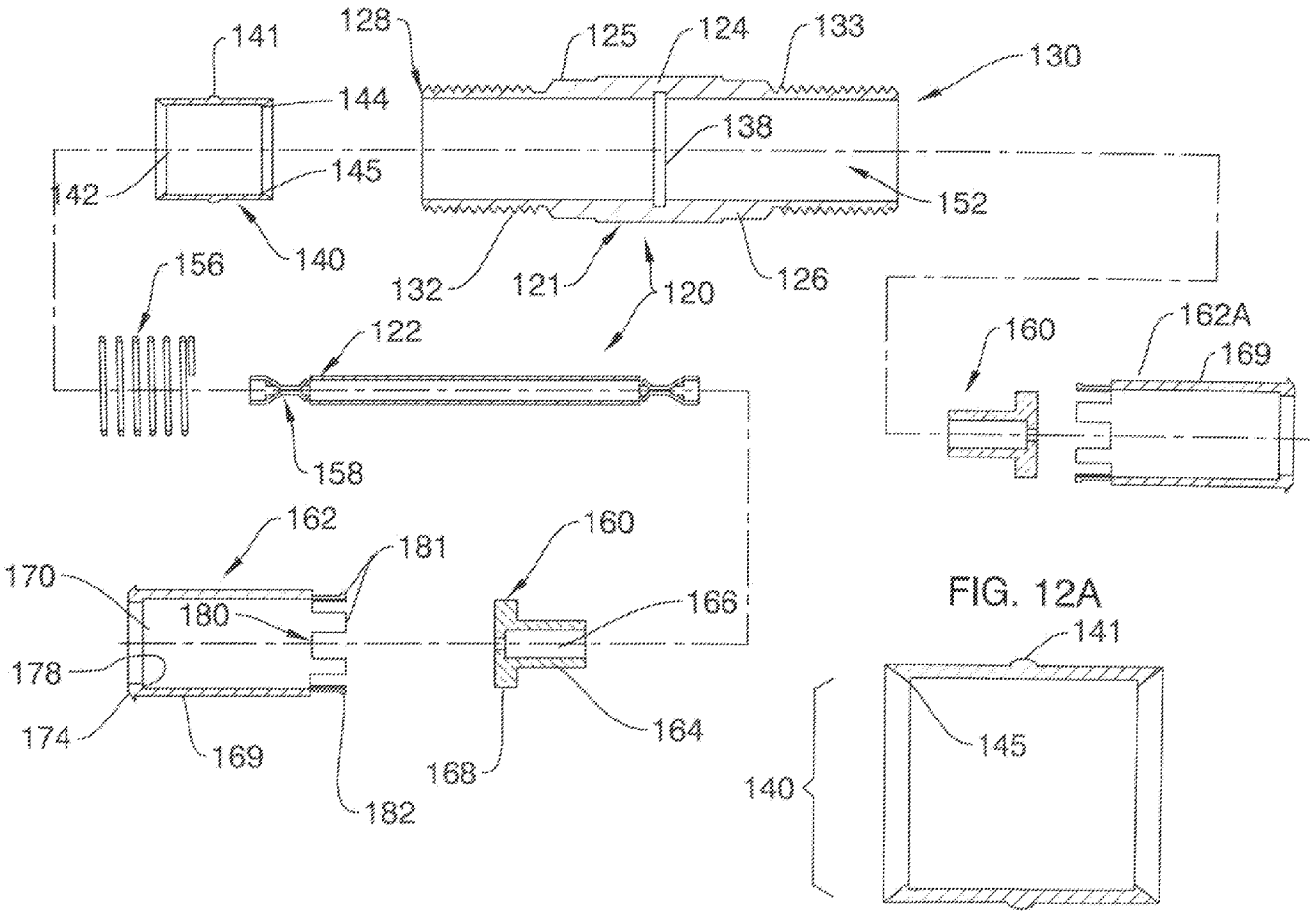
FIG. 12 is an exploded sectional view of the second barrel connector of FIGS. 9-11.

FIG. 11 illustrates the traveling sleeves 162 fully compressed inwardly. FIG. 9 shows the sleeves biased outwardly maximally. FIG. 10 shows an intermediate position that occurs during tightening of an F-connector. Traveling sleeve pressure from spring 156 prevents the F-connector nut from being somewhat loose, even if the installer failed to torque it properly.

Third Barrel Connector Embodiment

Barrel connector 220 (FIGS. 13-16) has an elongated and hollow body 221 quite similar to body 21 discussed above. An elongated contact tube 222 similar to tube 22 discussed earlier extends coaxially at the center. Body 221 (FIG. 14, 16) comprises a middle portion 224 integrally bounded by tubular shanks 225, 226. Portion 224 may have the cross section of a hexagon so it may be grasped with suitable tools. Shanks 225, 226 border external threaded portions 232, 233 (FIG. 16) that threadably receive a typical coaxial connector. Ends 228. 230 present female sockets to which an F-connector may be threadably attached.

Unlike connector body 21, the middle portion 224 of body 221 has no internal retainer ring or ring groove. However, there are a pair of spaced apart, anchoring grooves 244 and 246 internally concentric with shanks 225 and 226 respectively. A single tubular spring chamber 240 is disposed between anchoring grooves 244 and 246, each of which has a larger diameter than the axially adjacent spring chamber. A coiled spring 256 (FIG. 16) coaxially seats within chamber 240. In assembly, spring 256 is retained between traveling sleeves abutting it on each end.

Ends end of the contact tube 222 seats within a bushing 260 that is identical with bushing 60 described above. Bushing 260 has an integral, tubular stem 264 (FIG. 16) defining a tubular interior passageway 266 that slidably receives ends of contact tube 222. Stem 264 is integral with a larger diameter head 268 that slidably, coaxially penetrates passageway 270 defined within travelling sleeve 262. Travel is limited by shoulder 278.

Traveling sleeve 262 comprises an elongated shank 269 ending in a beveled head 274 with a diameter larger than the diameter of shank 269. An internal, reduced diameter shoulder 278 is integrally formed in the sleeve 262 proximate head 274. Sleeve shank 269 has a peripheral groove 277 formed at its opposite end proximate tip 279. A resilient, split lock anchor collar 280 (FIG. 16) seats on shank 269 and snaps into place on the traveling sleeve within groove 277. The annular anchor collar 280 has a plurality of radially spaced apart, barb-like catches 281 (FIG. 16) defined about its periphery.

Figure 14:
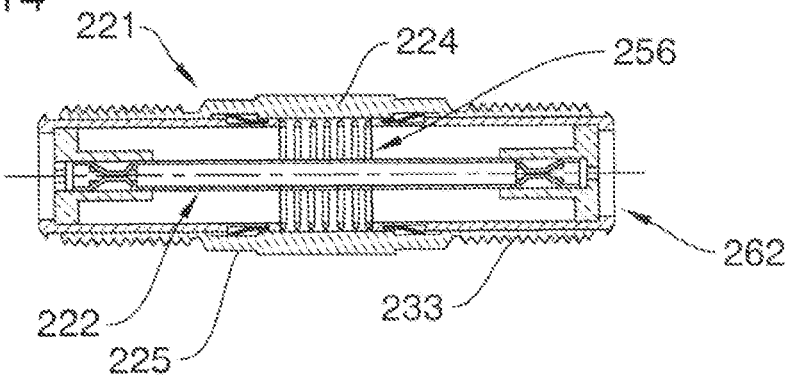
FIG. 14 is a longitudinal sectional view of the third embodiment of our barrel connector, showing the traveling sleeves partially extended.
Figure 15:
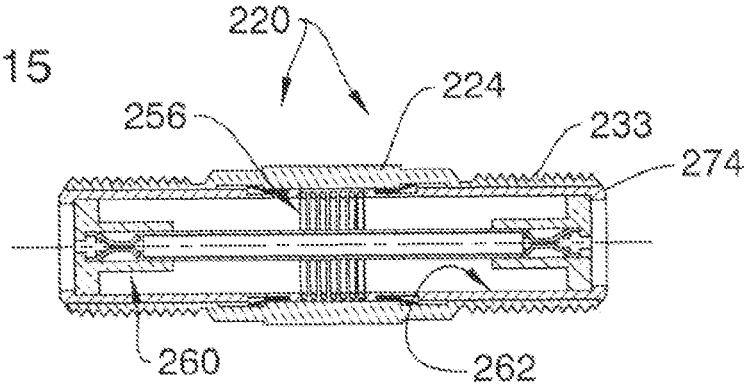
FIG. 15 is a longitudinal sectional view of the third embodiment of our barrel connector, showing the traveling sleeves compressed inwardly.
Figure 16:
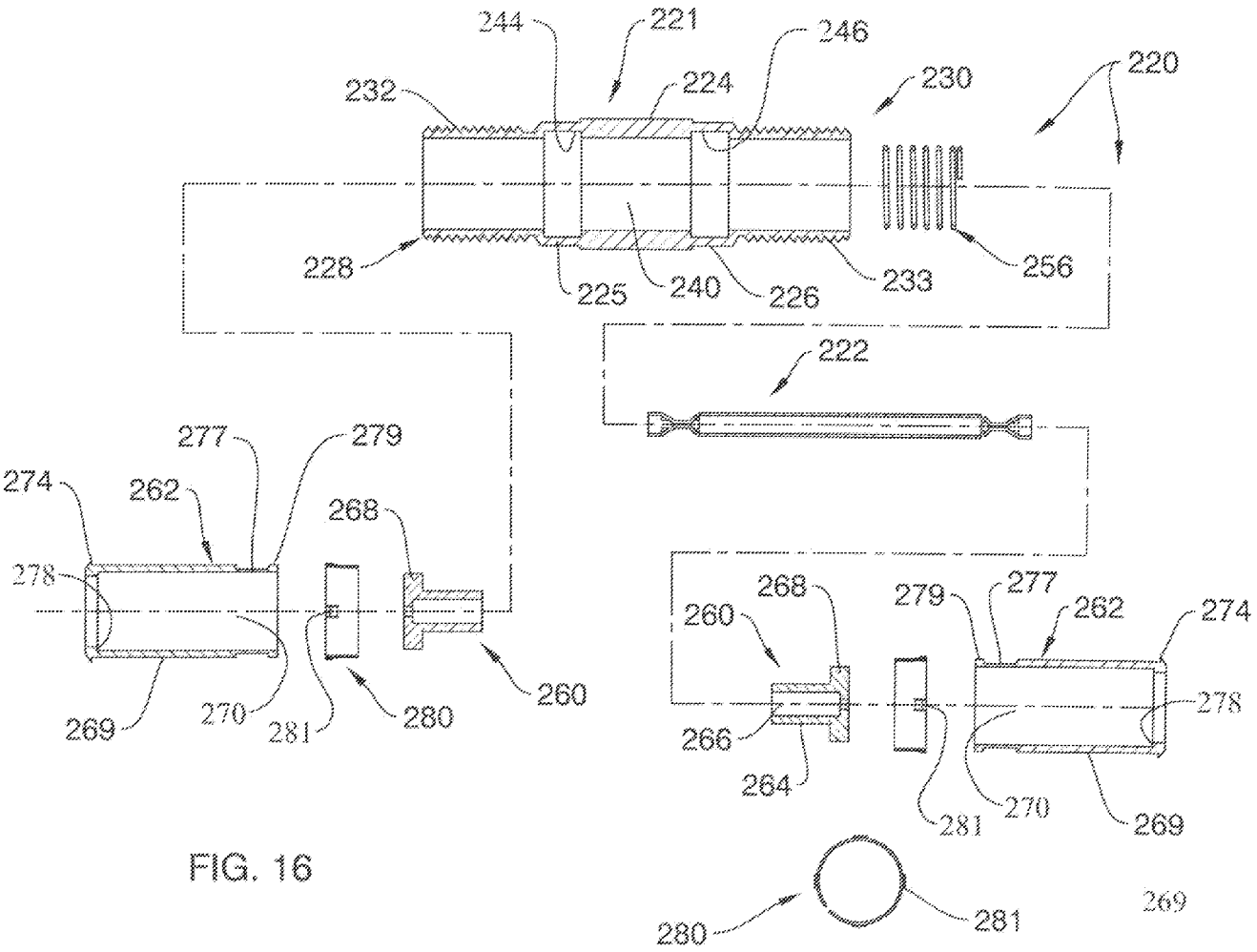
FIG. 16 is an exploded, sectional view of the barrel connector of FIGS. 13-15.

In assembly, as seen in FIGS. 14-16, the travelling sleeves 262 coaxially fit within the body 221 with their tips 279 bearing against opposite ends of spring 256. Spring pressure cannot dislodge sleeves 262 because anchor collar catches 281 are captivated within anchoring grooves 244 or 246. Catches 281 slidably, coaxially ride within anchoring grooves 244 or 246 a limited distance, and can travel axially within these grooves between the opposite groove ends. The spring 256 is retained by being sandwiched between the twin anchored traveling sleeves 262. Travel of catches 281 coincides with limited axial movements of the travelling sleeves 262. During assembly, when the traveling sleeve 262 is inserted into the body, the anchor ring snapped into place on shank 269 yieldably deflects when first inserted into body 221, and snaps back into place when the catches 281 seat within anchoring grooves 244, 246.

Figure 13:
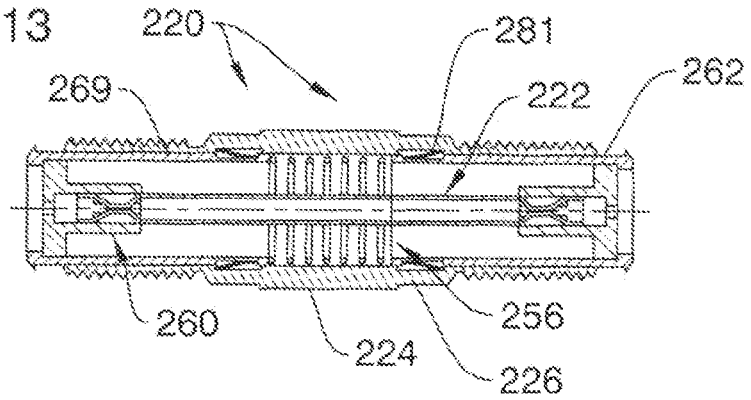
FIG. 13 is a longitudinal sectional view of a third embodiment of our barrel connector, showing the traveling sleeves fully extended.

In FIG. 13 both traveling sleeves 262 are maximally deflected out of the body 221 by spring pressure. In FIG. 15 the traveling sleeves 262 are fully compressed into body 221. Sleeve heads 274 abut the ends of the body 221 as before. When an F connector begins to tighten, the position of FIG. 14 is reached. Even if tightening is improper at this time, an effective ground path results.

Right Angled Connector/Adaptor Embodiment

Figure 17:
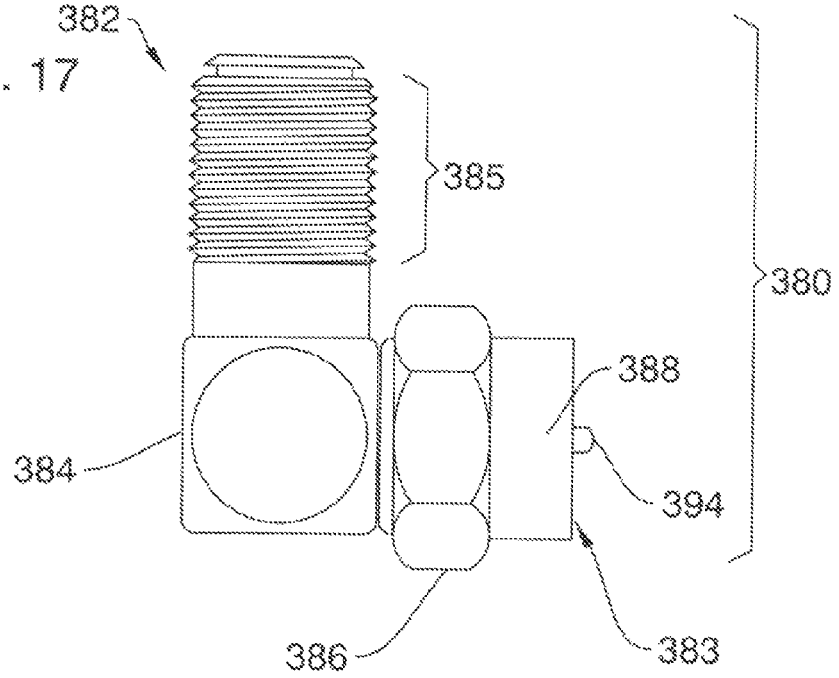
FIG. 17 is an elevational view of a right-angled coaxial adaptor with a preferred traveling, sleeve.
Figure 18:
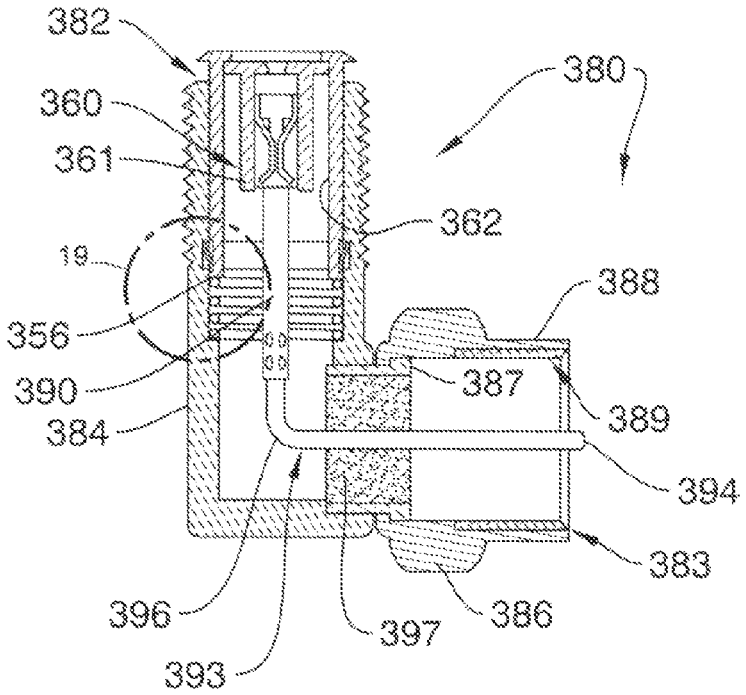
FIG. 18 is a sectional view of the adaptor of FIG. 17.
Figure 19:
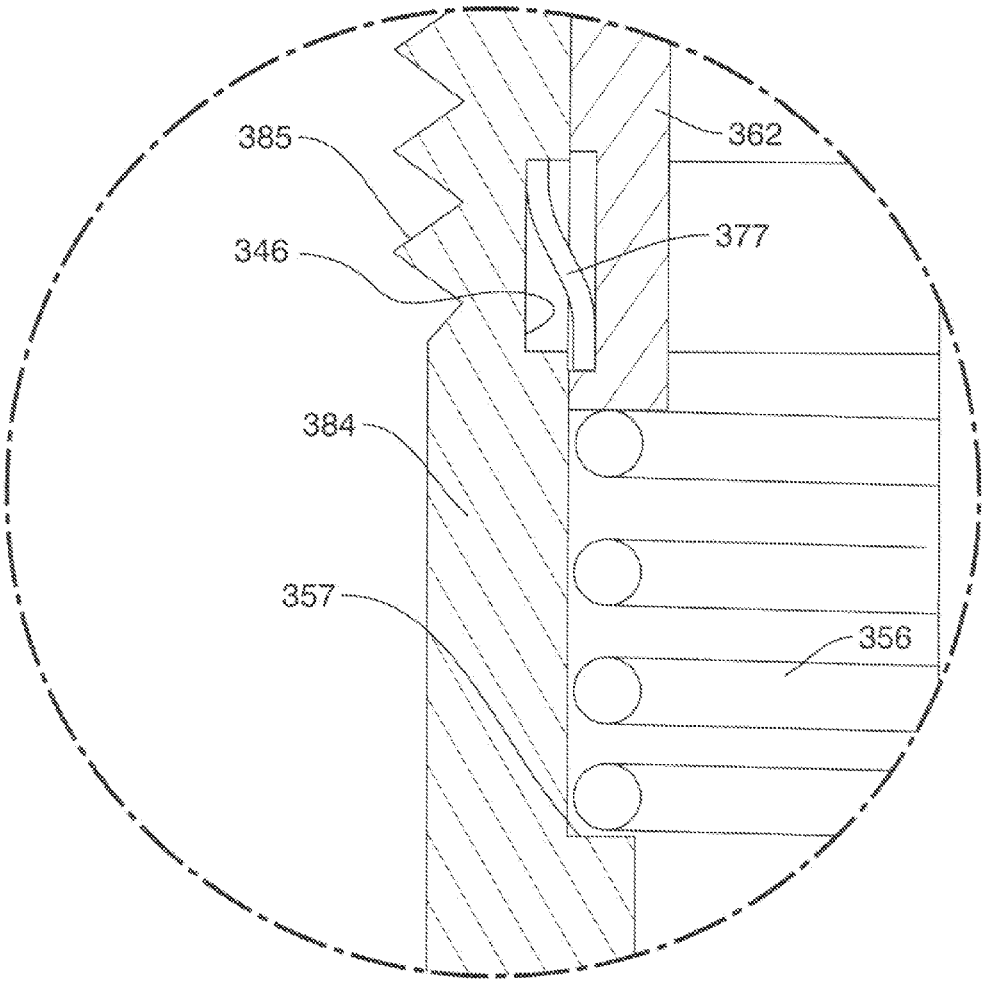
FIG. 19 is an enlarged, fragmentary sectional view of circled region 19 in FIG. 18.

FIGS. 17-19 illustrate a right angled connector or adaptor 380 whose exterior appearance is somewhat conventional. Adaptor 380 comprises opposed, angled-apart ends 382 and 383 that project from a generally cubicle union 384. Female end 382 comprises conventional exterior threads 385. The male end 383 comprises a rotatable hex head 386 that is rotatably secured by internal bushing 387 (FIG. 18). The integral, projecting sleeve 388 (FIG. 17) has internal threads 389 that mate with a suitably threaded socket establishing the female end of the connection.

The female end 382 (FIG. 18) of adaptor 380 has traveling sleeve structure to establish ground or continuity. A traveling sleeve 362 coaxially disposed within connector end 382 is outwardly biased by an internal, coiled spring 356 disposed within union 384. Spring 356 is retained against internal shoulder 357 (FIG. 19).

A shortened contact tube 390 extends coaxially into bushing 360 that is similar to bushings 60 and 260, for example, discussed above. Contact tube 390 resembles a half of the previously discussed contact tube 22 and said tubes end 58. The end of the contact tube extends coaxially within the tubular stem 361 of bushing 360 within connector end 382. The generally angled, generally L-shaped junction pin 393 has an integral male portion 394 extending through male adaptor end 383 that electrically and mechanically forms the "male" conductor of the adaptor 380. An elbow section 396 of pin 393 is restrained by a plastic grommet 397 inserted into bushing 387. Elbow section 396 of pin 393 has a vertical segment press fitted to contact tube 390.

As best seen in FIG. 19, the travelling sleeve 362 preferably has at least one protruding catch 377 formed in its periphery. Catch 377 anchors sleeve 362 similarly to catch 77 discussed above. In the best mode there are two radially spaced apart catches 377, but a plurality of similar catches can be can be radially defined about the external periphery of the travelling sleeve. Catches 377 anchor the traveling sleeve 362 by engaging internal anchoring groove 346. The resilient catches 377 yieldably deflect inwardly during assembly, and then spring back and occupy the anchoring groove 346 internally defined within the travelling sleeve. Limited displacements of the catch or catches 377 within the anchoring groove 346 allow slight axially deflections of the travelling sleeve. Alternatively, the catches 377 can resemble notches or barbs, a barbed anchor collar 280 (FIG. 16) previously discussed, or they can comprise protruding tongues or clips, as long as they readily seat within anchoring groove 346 and are slidable.

Single Socket Fitting Embodiment

Figure 20:
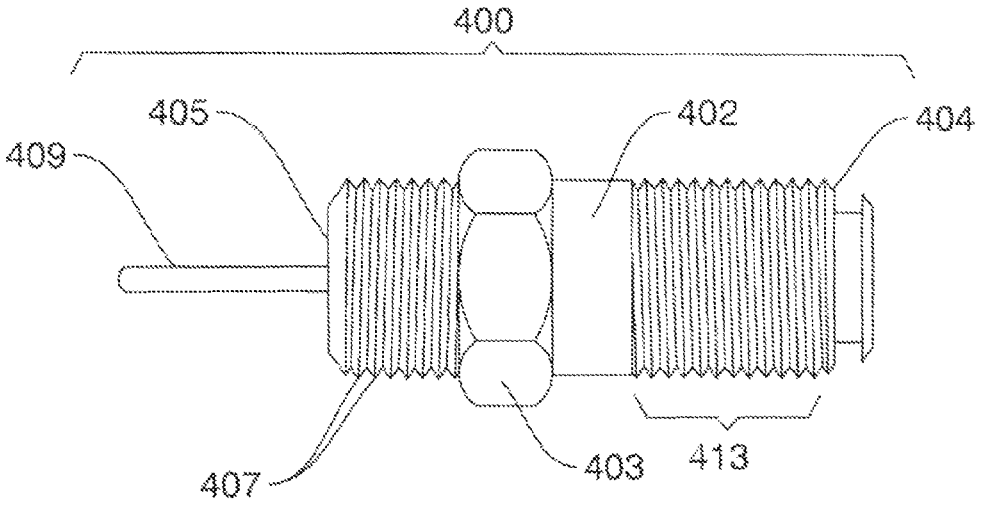
FIG. 20 is an elevational view of a single-socket, coaxial fitting with a preferred traveling sleeve.
Figure 21:
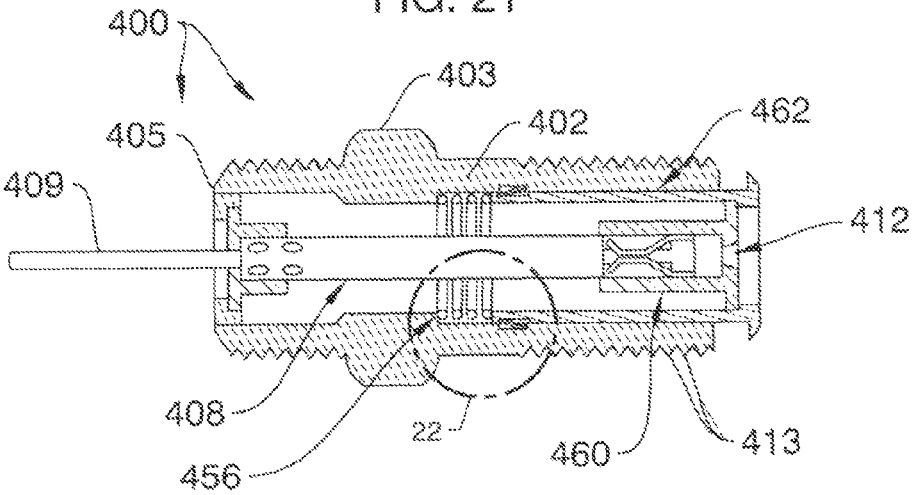
FIG. 21 is a longitudinal sectional view of the fitting of FIG. 20; and, FIG. 22 is an enlarged, fragmentary sectional view of circled region 22 in FIG. 21.
Figure 22:
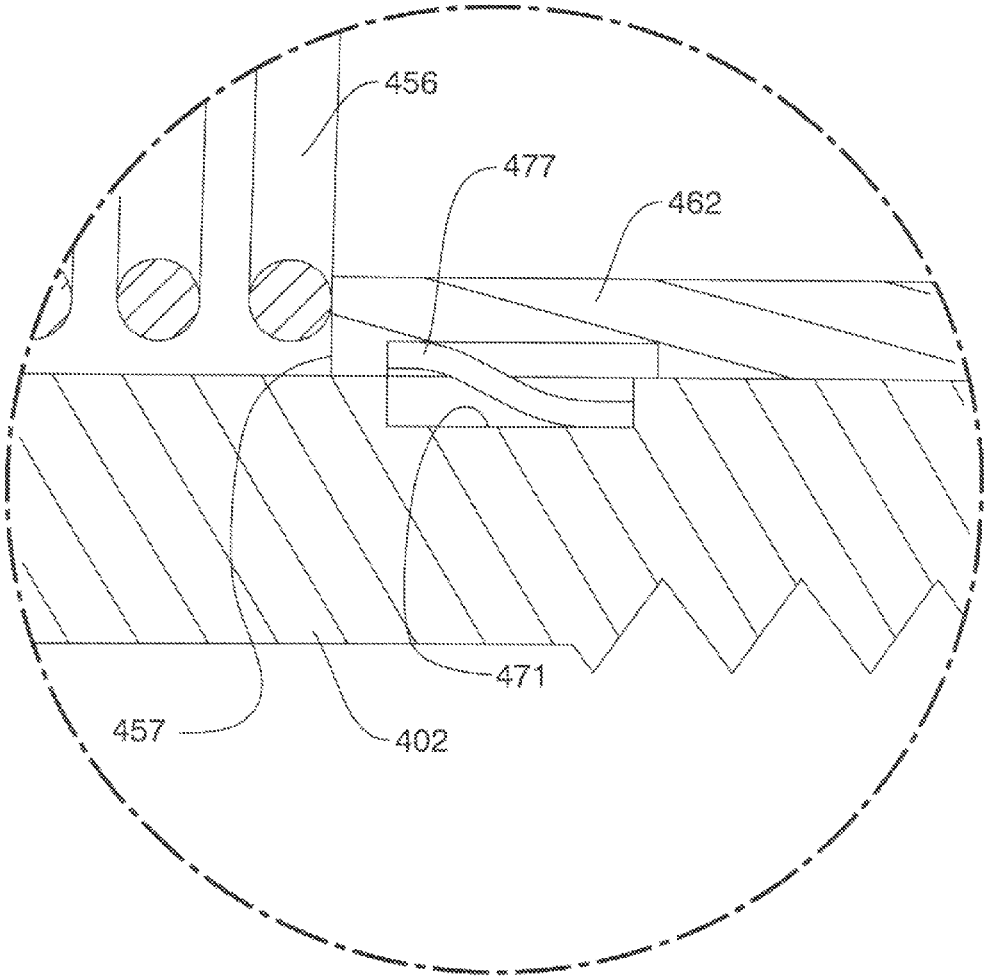

A single ended F-connector fitting 400 is illustrated in FIGS. 20-22. Fittings of this general arrangement can be employed in a wide variety of applications known in the art. As with previously discussed embodiments herein, fitting 400 can be configured for use with F-connectors, N-connectors, SMA connectors, BNC types, PL-259 connectors and the like.

The exterior appearance of fitting 400 (FIG. 20) is substantially similar to the prior art. A tubular body segment 402 (FIGS. 20, 21) integrally, coaxially extends from hex-nut portion 403. Female end 404 established a receptive socket to which an F-connector may be threadably attached by connection to conventional external threads 413. The opposite threaded end 405 of the fitting 400 may be fastened within an electronic component such as a circuit board or electronic chassis with a suitable nut engaging threads 407. Alternatively, threaded end 405 may be mated to a threaded socket.

At its left, contact tube 408 has a projecting conductor end 409 slidably coupled to it, and its opposite end is received within the shank of bushing 460 (similar to bushings 160, 260 discussed earlier). End 409 is solderable for electronic assembly.

The internal, coiled spring 456 abuts a retaining shoulder 457 (FIG. 21) coaxially defined within fitting 400 at the internal juncture of hex-nut portion 403 and body segment 402. Travelling sleeve 462 interiorly abuts the captivated, coiled spring 456, and is normally biased outwardly slightly of the fitting end 404 until an F-connector is coupled to it. Threads 413 enable connection to a coaxial connector, preferably an F-connector, whose center wire projection is inserted and grasped within the contact tube right end through orifice 412.

Referring to FIG. 22, the body 402 has an internal anchoring groove 471 defined in it. The travelling tube 462 has at least one catch 477 that is similar to catch 77 discussed above that anchors the sleeve by riding within the anchoring groove 471. The resilient catches 477 yieldably deflect inwardly during assembly and then spring back and "catch" within groove 471 to enable limited axial displacements of the traveling tube 462, while anchoring the sleeve to prevent disengagement. As before, different catch shapes and designs are possible. For example, catches 477 can comprise notches, barbs, projecting pins or nubs, a slit-ring like anchor collar 280 (FIG. 16) previously discussed, or they can comprise protruding tongues or clips. In each case the catch 477 must spring seat within the groove 471.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus comprising: a female socket adapted to be engaged by a coaxial connector wherein the female socket comprises:

a body comprising an end for engaging the coaxial connector;

a sleeve disposed within the body, wherein the sleeve is configured for axial movement within the body and outwardly from the body;

a bushing disposed within the sleeve, wherein the bushing is configured for axial movement within the body and outwardly from the body; and a tube disposed within the sleeve, wherein the tube is configured to accept a center conductor from the coaxial connector.

2. The apparatus according to claim 1 further comprising a spring disposed within the body, wherein the spring is configured to axially bias the sleeve.

3. The apparatus according to claim 2 further comprising a catch, a barb, a notch, or a prong configured to limit the axial movement of the sleeve.

4. The apparatus according to claim 3 wherein the apparatus comprises a catch and the body comprises a shank and a groove operable with the catch to limit the axial movement of the sleeve.

5. The apparatus according to claim 3 wherein the apparatus comprises a catch, wherein the catch is resilient and operative to deflect inwardly.

6. The apparatus according to claim 2 wherein the sleeve and the spring are configured to maintain electrical connection with the coaxial connector even when the coaxial connector is not fully installed upon the female socket.

7. The apparatus according to claim 2 wherein the sleeve comprises an elongated shank that contacts the spring.

8. The apparatus according to claim 2 further comprising a bushing slidably seated within the sleeve, wherein the tube is slidably seated within the bushing.

9. The apparatus according to claim 2 further comprising a tubular spring housing disposed within the body, wherein the tubular spring housing is retained within the body by one or more protrusions, one or more anchoring grooves, or one or more shanks.

10. The apparatus according to claim 2 wherein the female socket is of the type selected from the group consisting of F, RCA, BNC, and PL-259 connectors.

11. The apparatus according to claim 2 wherein the female socket is an F-connector type having external threads.

12. The apparatus according to claim 1 wherein the body, the sleeve, and the tube are electrically conductive.

13. The apparatus according to claim 1 further comprising a second female socket wherein:

the second female socket shares the body and the tube of the female socket;

the second female socket further comprises a second sleeve disposed within the body;

the second sleeve is configured for axial movement within the body;

the tube is disposed within the second sleeve; and wherein the tube is configured to accept a center conductor from a second coaxial connector.

14. The apparatus according to claim 13 further comprising a spring disposed within the body, wherein the spring is configured to axially bias the sleeve and a second spring disposed within the body, wherein the second spring is configured to axially bias the second sleeve.

15. The apparatus according to claim 14 wherein the body further comprises a retainer ring wherein the retainer ring is disposed between the spring and the second spring.

16. The apparatus according to claim 14 wherein the female socket is of the type selected from the group consisting of F, RCA, BNC, and PL-259 connectors and wherein the second female socket is of the type selected from the group consisting of F, RCA, BNC, and PL-259 connectors.

17. The apparatus according to claim 16 wherein the female socket is an F-connector type having external threads and the second female socket is an F-connector type having external threads.

18. The apparatus according to claim 14 wherein the sleeve and the spring are configured to maintain electrical connection with the coaxial connector even when the coaxial connector is not fully installed upon the female socket and wherein the second sleeve and the second spring are configured to maintain electrical connection with the second coaxial connector even when the second coaxial connector is not fully installed upon the second female socket.

19. The apparatus according to claim 13 further comprising a tubular spring housing disposed within the body, wherein the tubular spring housing is retained within the body by one or more protrusions, one or more anchoring grooves, or one or more shanks.

20. The apparatus according to claim 1 further comprising a male end at a right angle with reference to the female socket and that is adapted to engage a socket, wherein the male end comprises an L-shaped junction pin.

21. The apparatus according to claim 20 further comprising a spring disposed within the body, wherein the spring is configured to axially bias the sleeve.

22. The apparatus according to claim 21 further comprising a catch, a barb, a notch, or a prong configured to limit the axial movement of the sleeve.

23. The apparatus according to claim 21 further comprising a bushing slidably seated within the sleeve, wherein the tube is slidably seated within the bushing.

24. The apparatus according to claim 21 wherein the female socket is of the type selected from the group consisting of F, RCA, BNC, and PL-259 connectors.

25. The apparatus according to claim 24 wherein the female socket is an F-connector type having external threads.

26. The apparatus according to claim 25 wherein the male end is an F-connector type further comprising a hexagonal nut with internal threads.

27. The apparatus according to claim 21 wherein the sleeve and the spring are configured to maintain electrical connection with the coaxial connector even when the coaxial connector is not fully installed upon the female socket.

28. The apparatus according to claim 1 further comprising a male end axially aligned with the female socket and that is adapted to engage a socket, wherein the male end comprises a projecting conductor coupled to the tube.

29. The apparatus according to claim 28 further comprising a spring disposed within the body, wherein the spring is configured to axially bias the sleeve.

30. The apparatus according to claim 29 further comprising a catch, a barb, a notch, or a prong configured to limit the axial movement of the sleeve.

31. The apparatus according to claim 29 further comprising a bushing slidably seated within the sleeve, wherein the tube is slidably seated within the bushing.

32. The apparatus according to claim 29 wherein the female socket is of the type selected from the group consisting of F, RCA, BNC, and PL-259 connectors.

33. The apparatus according to claim 32 wherein the female socket is an F-connector type having external threads.

34. The apparatus according to claim 33 wherein the male end is an F-connector type further comprising a hexagonal nut with internal threads.

35. The apparatus according to claim 29 wherein the sleeve and the spring are configured to maintain electrical connection with the coaxial connector even when the coaxial connector is not fully installed upon the female socket.

* * * * *